US005707270A

United States Patent [19]

Johnson et al.

[11] Patent Number: 5,707,270

[45] Date of Patent: Jan. 13, 1998

[54] SYSTEM FOR DETONATING A PERCUSSION CAP IN A TOY PROJECTILE

[76] Inventors: Lonnie G. Johnson, 4030 Ridgehurst Dr., Smyrna, Ga. 30080; John T. Applewhite, 138 Belmonte Dr., SW., Atlanta, Ga. 30311

[21] Appl. No.: 168,677

[22] Filed: Dec. 16, 1993

[51] Int. Cl.[6] ..... A63H 5/00

[52] U.S. Cl. ..... 446/400; 446/402

[58] Field of Search ..... 446/400, 398, 446/402

[56] References Cited

U.S. PATENT DOCUMENTS

| | | | |
|---|---|---|---|
| 1,425,198 | 8/1922 | Hampel | 446/400 |
| 2,710,490 | 6/1955 | Wildstein . | |
| 2,757,932 | 8/1956 | Shaw | 446/400 |
| 3,059,376 | 10/1962 | Wildstein | 446/400 |
| 3,183,623 | 5/1965 | Callen | 446/400 |

*Primary Examiner*—Robert A. Hafer
*Assistant Examiner*—Jeffrey D. Carlson
*Attorney, Agent, or Firm*—Michael Drew

[57] ABSTRACT

A firing post is generally positioned at the center of the top end of the body of a toy projectile to receive a percussion cap cartridge. The toy projectile has a soft outer body made of light-weight, pliable, compressible material such as polystyrene. The firing post and cartridge are covered with a nose of compressible material which generally houses a hammer and firing pin in alignment with the firing post. A spring-loaded hammer and firing pin is cocked by sliding the hammer through a housing for the hammer until a notch in the stem of the hammer is engaged by the top of the hammer housing. The trigger is a lever which is movable against the inclined top end of the hammer stem. The hammer and trigger assembly may be rotated with respect to a firing chamber placed over a multiple-cartridge mount to successively fire caps on the mount. A spring-loaded index helps facilitate alignment of the trigger-hammer assembly and holes in the firing chamber.

4 Claims, 4 Drawing Sheets

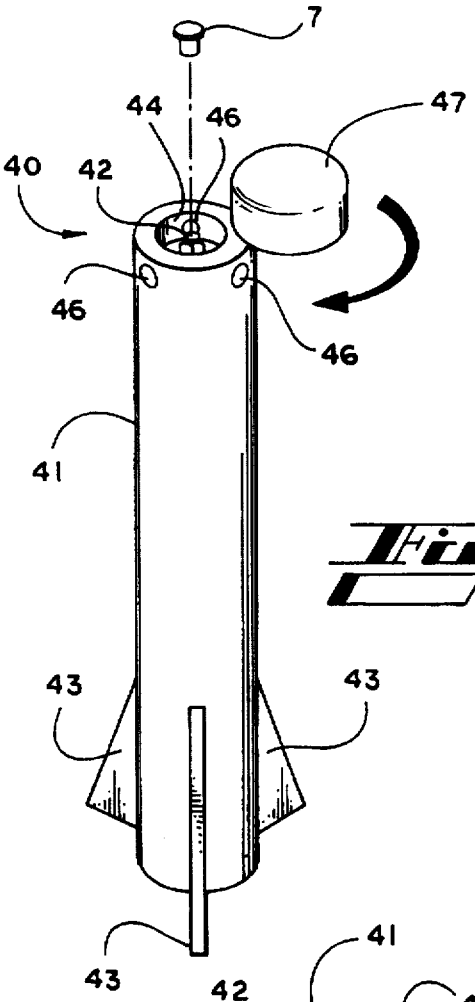
Fig_6
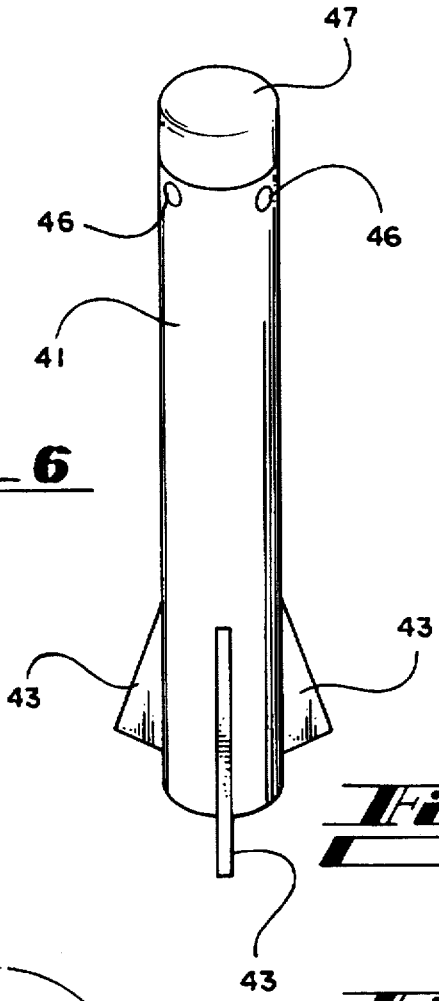
Fig_9
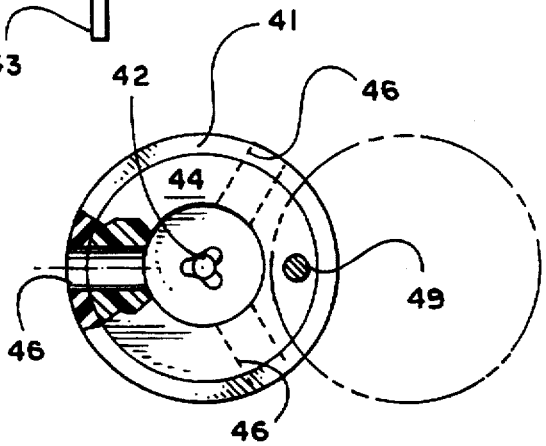
Fig_8
Fig_7
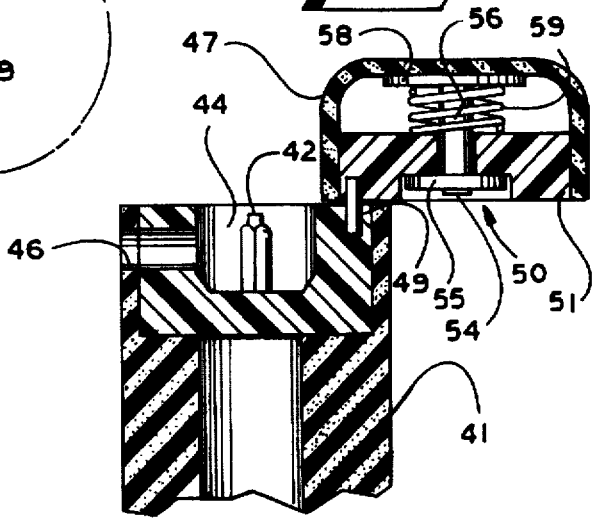

SYSTEM FOR DETONATING A PERCUSSION CAP IN A TOY PROJECTILE

TECHNICAL FIELD OF THE INVENTION

The present invention relates to toy projectiles such as toy rocket-shaped, polystyrene arrows and missiles, and more particularly to systems for detonating percussion caps in such toys.

BACKGROUND OF THE INVENTION

The bang and fumes emitted when percussion caps are detonated provide an element of excitement that makes many toys more enjoyable. In rocket-shaped toy projectiles made of metal a percussion cap is normally detonated by placing the percussion cap between a metal hammer and anvil type of mechanism located along the centerline of the toy projectile and causing the projectile to be impelled head first upon a resistant surface such as the ground or a wall. The impact force which causes the cap to detonate is due to the mass, or weight, of the projectile. Light-weight toy projectiles such as toy arrows and missiles made from polystyrene or other light-weight materials are safer than toy projectiles made from metal or other weighty materials because they strike individuals or objects with less impact force. However, because of their lower mass, these light-weight toy projectiles do not strike the ground or other surfaces with sufficient force to detonate percussion caps. It can be appreciated that it would be desirable to have a means for detonating percussion caps in a light-weight toy projectile.

SUMMARY OF THE INVENTION

It is an object of the invention to provide a means for detonating percussion caps in a light-weight toy projectile.

According to several preferred embodiments of the present invention, a firing post is positioned at the center of the top end of the body of a toy projectile to receive a percussion cap cartridge. The firing post and cartridge may be covered with a nose of compressible material which houses a hammer and firing pin in alignment with the firing post. In one of two alternate embodiments, the nose cover, hammer and firing pin may be positioned over the front end of the body of the projectile by a hinge which permits the nose cover to be rotated vertically with respect to the projectile body. In the alternate embodiment, a hinge permits the nose cover to be rotated horizontally with respect to the projectile body. In yet another preferred embodiment of the invention, a compressible nose covering houses a spring-loaded hammer and firing pin that is cocked by sliding the hammer through a housing for the hammer until a notch in the stem of the hammer is engaged by the top of the hammer housing. The trigger is a lever which is movable against the inclined top end of the hammer stem. The hammer and trigger assembly may be rotated with respect to a firing chamber placed over a multiple-cartridge mount to successively fire caps on the mount. A spring-loaded index helps facilitate alignment of the trigger-hammer assembly and holes in the firing chamber.

Other aspects, objects, features, and advantages of the present invention will become apparent to those skilled in the art upon reading the detailed description of preferred embodiments.

BRIEF DESCRIPTION OF THE DRAWINGS

FIG. 6 is an isometric illustration of a swivel-top-nose system for detonating a percussion cap in a toy projectile according to a preferred embodiment of the invention.

FIG. 7 is a cross-sectional illustration of the system of FIG. 6.

FIG. 8 is a top plan view of the system of FIG. 6.

FIG. 9 is an isometric illustration of the system of FIG. 6 with the nose positioned onto body of the projectile.

DETAILED DESCRIPTION OF PREFERRED EMBODIMENTS OF THE INVENTION

While the specification concludes with claims particularly pointing out and distinctly claiming the subject matter which is regarded as the present invention, the invention will now be described with reference to the following description of embodiments taken in conjunction with the accompanying drawings.

The invention provides a system which detonates a percussion cap in a toy projectile by maximizing the impact force of the projectile upon the charge of the percussion cap. The impact force of the projectile is maximized by focusing the impact force upon the minimized surface area of a firing post upon which a percussion cap cartridge is mounted. Maximization of the impact force in the manner described particularly enables percussion caps to be detonated due to the momentum of light-weight masses such as safe toy projectiles made from polystyrene or similar light-weight substances.

Figure 1:
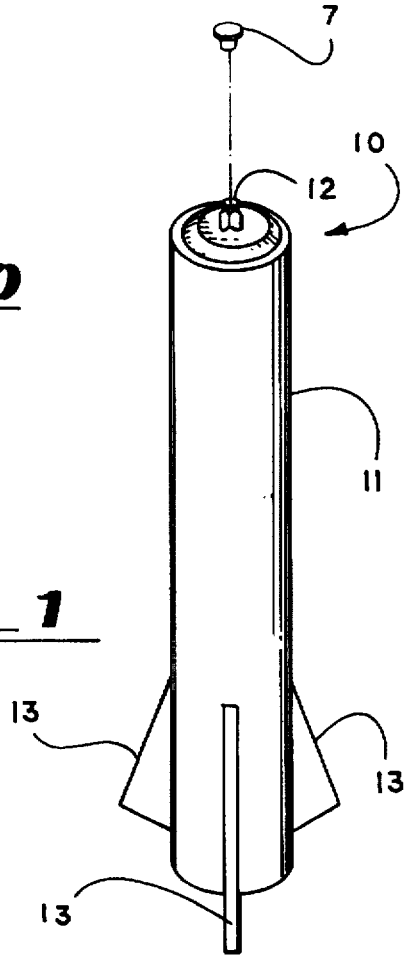
FIG. 1 is an isometric illustration of a system for detonating a percussion cap in a toy projectile according to a preferred embodiment of the invention.

Referring first to FIG. 1, a system for detonating percussion caps in a toy projectile 10 according to a preferred embodiment of the invention is illustrated. The system 10 is a simple system in which a toy rocket, consisting of the rocket body 11 and wings 13, is the toy projectile. A firing post 12 over which a percussion cap 7 is to be placed is affixed to the center of the front end of the rocket body 11.

Figure 2:
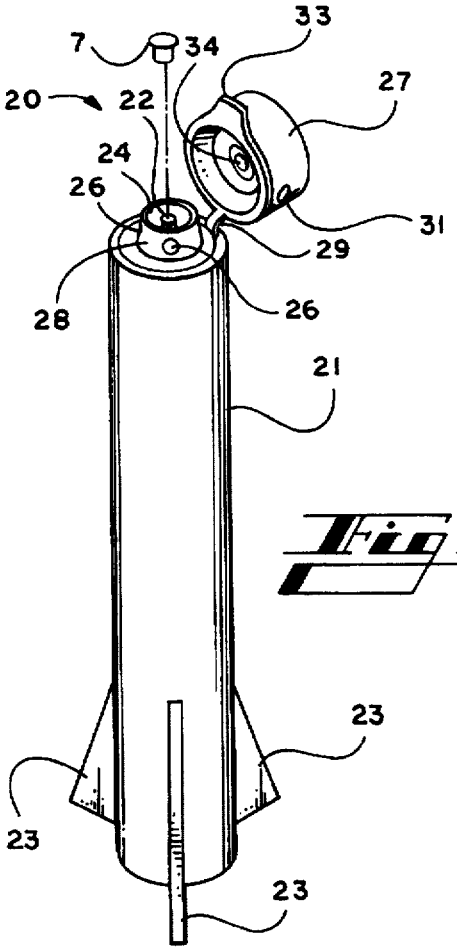
FIG. 2 is an isometric illustration of a flip-top-nose system for detonating a percussion cap in a toy projectile according to a preferred embodiment of the invention.
Figure 3:
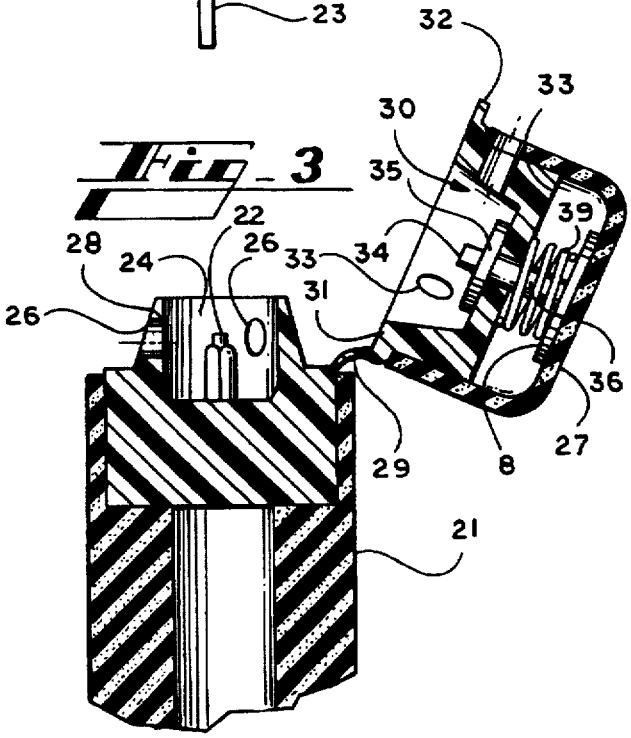
FIG. 3 is a cross-sectional illustration of the system of FIG. 2.

Referring now to FIG. 2, therein is illustrated a flip-top-nose system for detonating percussion caps in a toy projectile 20 according to a preferred embodiment of the invention. Referring now also to the sectional illustration of FIG. 3, the flip-top-nose system 20 has a firing post 22 mounted at the center of the top of the rocket body 21. Fins 23 are attached to the rocket body 21. A wall 24 encircles the firing post 22 and serves as a firing chamber, a guide for receiving the nose and guide for aligning the hammer assembly 30 and firing pin 34 of the system 20. The walled chamber 24 has exhaust ports 26 for releasing fumes from detonated caps 7. A generally cylindrically-shaped hammer assembly support 31 is housed within the nose covering 27. The contour of the inner wall of the hammer assembly support 31 corresponds to and matches the contour of the outer surface 28 of the firing chamber 24 wall to facilitate alignment of the nose section over the top of the rocket body 21. A hinge 29 connects the hammer assembly support 31 (and thus the nose in general) to the top of the rocket body 21. A tab-like handle 32 extends from the hammer assembly support 31 as a means for flipping open the nose of the projectile. The hammer assembly support 31 has exhaust ports 33 that align with the exhaust ports 26 of the firing chamber 24 when the nose is placed over the rocket body 21. A firing pin 34 is located at the lower end of the hammer assembly 30. A disk-shaped hammer guide 35 is affixed between the firing pin 34 and hammer stem 36. The hammer guide 35 and inner wall of the firing chamber 24 are shaped to correspond to one another so that the hammer guide 35 can slide within the firing chamber 24, thereby helping to align the firing pin 34 and firing post 22 with one another when the nose is positioned over the rocket body 21. The hammer stem 36 extends through the hammer assembly support 31 and terminates in a hammer strike plate 38. The hammer strike plate 38 is positioned at the top of the hammer stem 36 adjacent the nose covering 27. A spring 39 biases the hammer and firing pin 34 away from the firing post 22.

Figure 4:
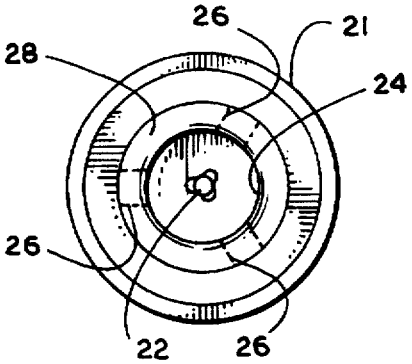
FIG. 4 is a top plan view of the system of FIG. 2.

Referring now to the top view of FIG. 4, the positioning of the firing post 22 of the system 20 within the chamber wall 24 is further illustrated. The three exhaust ports 26 of the embodiment are also illustrated.

Figure 5:
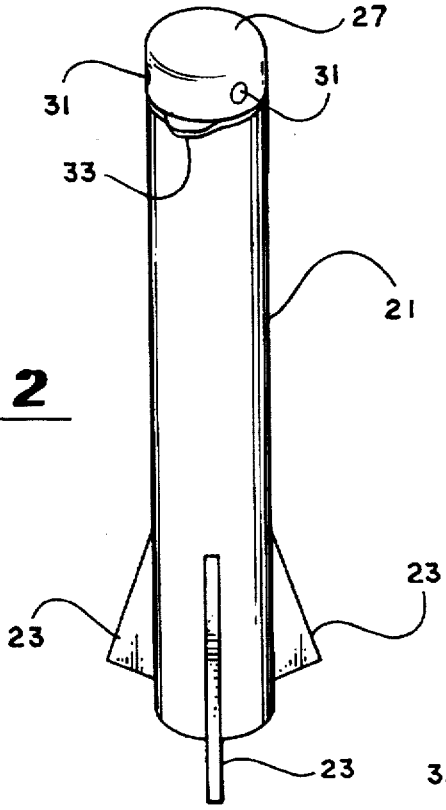
FIG. 5 is an isometric illustration of the system of FIG. 2 with the nose positioned onto body of the projectile.

Referring now to FIG. 5, therein is shown the rocket of the flip-top-nose system for detonating percussion caps in a toy projectile 20 with its nose in place, ready for detonation of a percussion cap.

Referring now to FIG. 6, therein is illustrated a swivel-top-nose system for detonating percussion caps in a toy projectile 40 according to a preferred embodiment of the invention. Referring now also to the sectional illustration of FIG. 7, the swivel-top-nose system 40 has a firing post 42 mounted at the center of the top of the rocket body 41. Wings 43 are attached to the rocket body 41. A cavity (or chamber) 44 within which the firing post 42 rests serves as a firing chamber and guide for aligning the hammer assembly 50 and firing pin 54 of the system 40. The chamber 44 has exhaust ports 46 extending through the rocket body 41 for releasing fumes from detonated caps 7. A cylindrically-shaped hammer assembly support 51 is housed within the nose covering 47. The hammer assembly support 51 is pivotally connected to the head of rocket body 41 by a pin 49 creating a hinge. A firing pin 54 is located at the lower end of the hammer assembly 50. A disk-shaped hammer guide 55 is affixed between the firing pin 54 and hammer stem 56. The hammer guide 55 and inner wall of the firing chamber 44 are shaped to correspond to one another so that the hammer guide 55 can slide within the firing chamber 44, thereby helping to align the firing pin 54 and firing post 42 with one another when the nose is positioned over the rocket body 41. The hammer stem 56 extends through the hammer assembly support 51 and terminates in a hammer strike plate 58. The hammer strike plate 58 is positioned at the top of the hammer stem 56 adjacent the nose covering 47. A spring 59 biases the hammer and firing pin 54 away from the firing post 42.

Referring now to the top view of FIG. 8, the positioning of the firing post 42 of the system 40 within the chamber wall 44 is further illustrated. The three exhaust ports 46 of the embodiment are also illustrated.

Referring now to FIG. 9, therein is shown the rocket of the swivel-top-nose system for detonating percussion caps in a toy projectile 40 with its nose in place, ready for detonation of a percussion cap.

Figure 10:
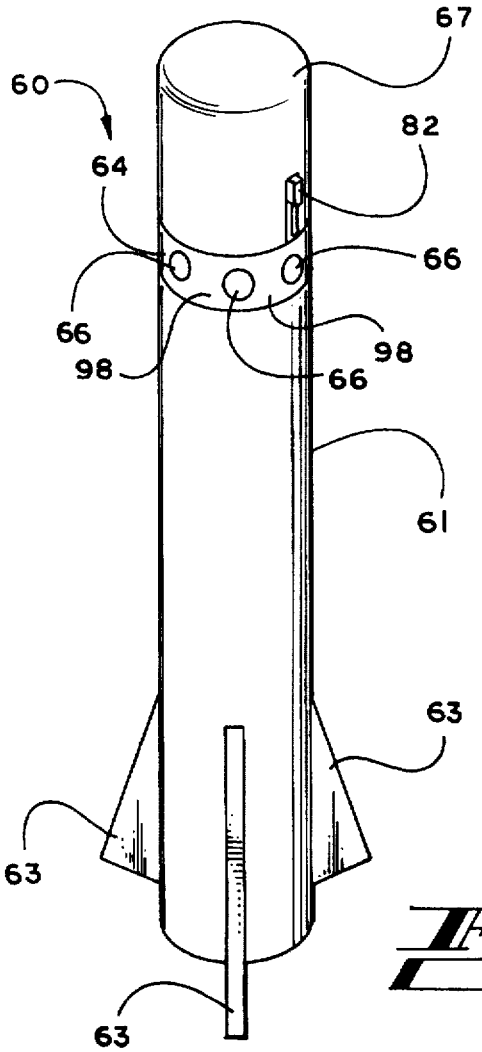
FIG. 10 is an isometric illustration of a multiple-load system for detonating a percussion cap in a toy projectile according to a preferred embodiment of the invention.
Figure 12:
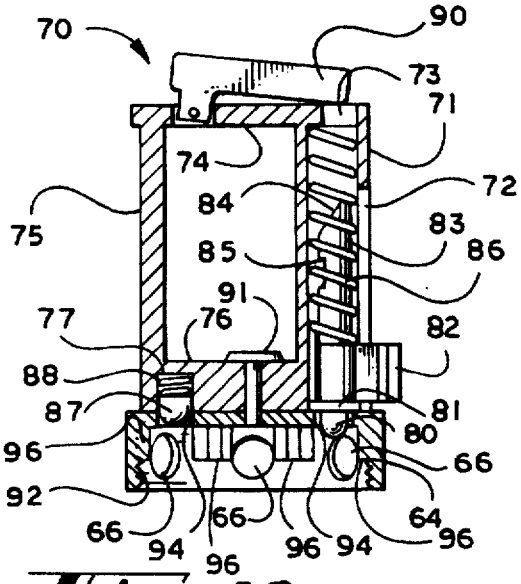
FIG. 12 is a cut-away sectional illustration of the trigger-hammer assembly of the system of FIG. 10.
Figure 14:
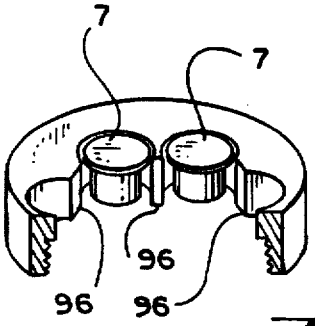
FIG. 14 is a partial sectional, cut-away isometric illustration the firing chamber of the system of FIG. 10.
Figure 11:
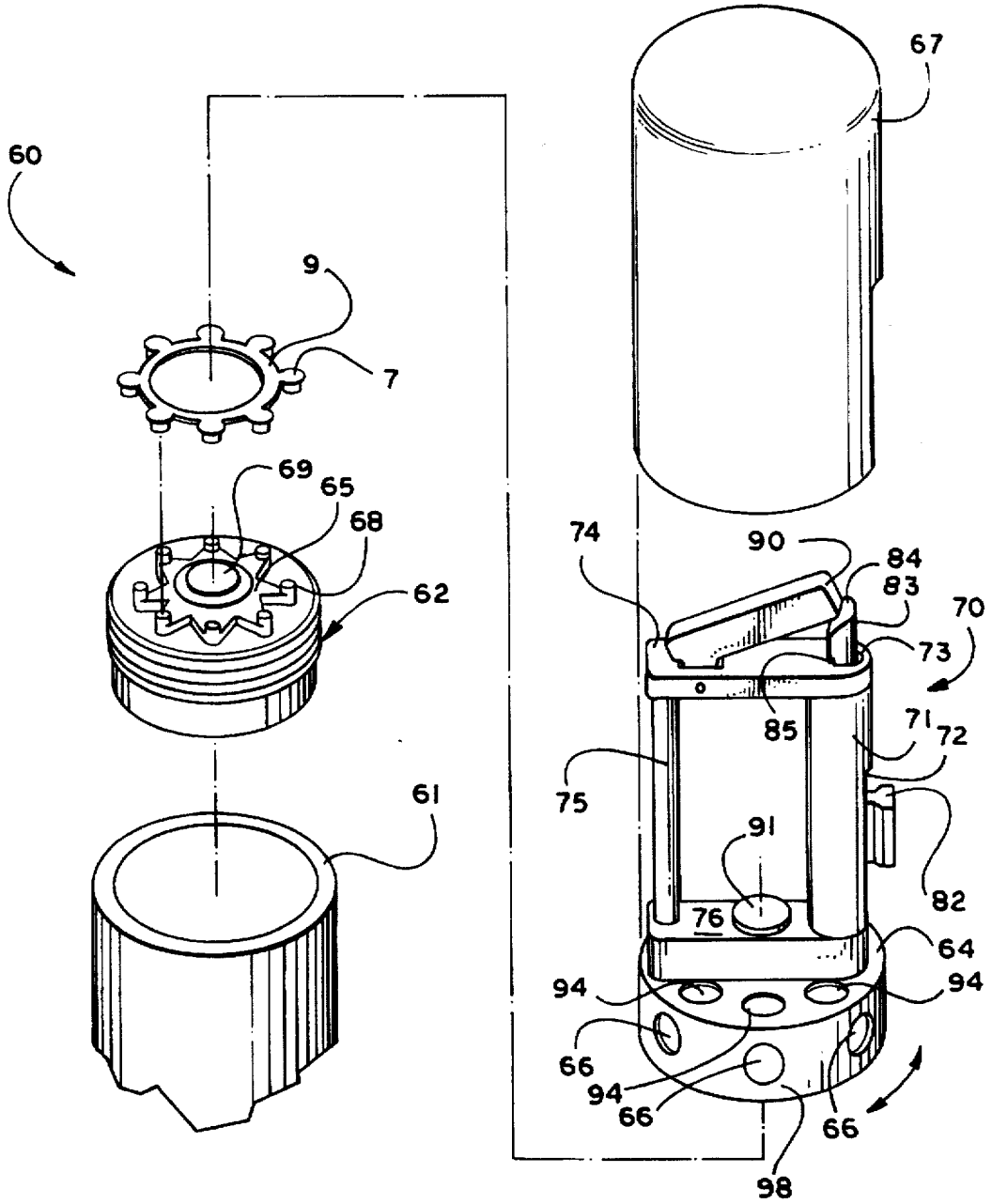
FIG. 11 is an exploded view of the system of FIG. 10.
Figure 13:
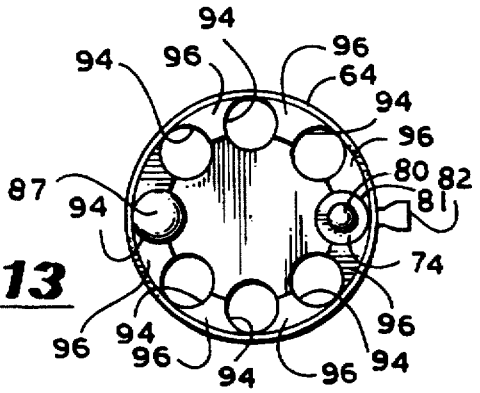
FIG. 13 is a bottom plan view of the trigger-hammer assembly of the system of FIG. 10.

Referring now to FIG. 10, therein is illustrated a multiple load system for detonating a percussion cap in a toy projectile 60 according to a preferred embodiment of the invention. In FIG. 10, the rocket body 61, wings 63, outside of the firing chamber 64, exhaust ports 66 of the firing chamber 64, nose cover 67, and hammer lever 82 of the system 60 are clearly shown. Referring now more particularly to the exploded view of FIG. 11, the main components of the system 60 are may be seen. The multiple-load system 60 is capable of carrying more than one percussion cap cartridge 7 and is capable of carrying multiple cap cartridges formed into a cartridge ring 9. The threaded top end 62 of the rocket body is designed to mate with threads (not seen in this view) on the inner surface of the firing chamber 64. A multiple cartridge mount 65, containing multiple firing posts 68, is attached in a rotatable manner to the top of the rocket body 61 by a spindle 69. Referring now to FIGS. 11 and 12 simultaneously, the foundation of a trigger-and-hammer assembly 70 consists of a four-sided structure. One vertical leg of the quadrilateral is a tubular housing 71 for the hammer and firing pin. The top horizontal portion 74 of the trigger-and-hammer assembly 70 also serves as a support for the trigger for the system 60. The second vertical leg 75 of the assembly 70 is a stabilizing support piece. The bottom horizontal portion 76 of the assembly 70 serves as a means for connecting the assembly 70 to the firing chamber 64 and also has a cavity 77 for housing a spring-loaded 88 indexing pin 87 for the system 60. The hammer housing 71 has a slot 72 in its outer side through which the hammer lever 82 may extend. The bottom of the housing 71 is open through the bottom horizontal portion 76. A top opening 73 for the hammer housing 71 extends through the top horizontal portion 74 of the assembly 70 and has an inner edge that is offset from the inner most wall of the housing 71. The striking element of the system consists of a firing pin 80 attached to a hammer guide 81 followed by a hammer stem 83. The hammer guide 81 shown is a ring having a center that is coincident with the axis of the firing pin 80. The circumferential configuration of the hammer guide 81 corresponds to and is slidable with respect to the inner cross-sectional area of the hammer housing 71. The hammer guide 81 thus centers the hammer and firing pin 80 in the hammer housing 71 and over each hole 94 in the top of the firing chamber housing 64. As previously mentioned, the hammer lever 82 is attached along the side of the hammer stem 83 and extends through the slot 72 in the hammer housing 71. The top 84 of the hammer stem 83 is inclined and a notch 85 is formed in the stem 83 on the side opposite the hammer lever 82. A spring 86 biases the hammer and firing pin 80 downward. The trigger 90 for the system 60 is a lever attached to the upper horizontal portion of the assembly 70. The cavity 77 formed at the bottom of the assembly structure 70 holds an indexing knob 87 biased outwardly of the cavity by a spring 88. The assembly 70 is pivotable with respect to the firing chamber 64 about a spindle 91 connecting the two features of the system 60. The firing pin 80 is able to protrude into the firing chamber 64 through holes 94 formed at the top of the firing chamber 64. The diameter of the index knob 87 is slightly larger than the diameter of the holes 94 of the firing chamber 64 so that the index knob 87 is able to protrude only slightly into a hole 94. Referring now also to the bottom plan view of the assembly 70 of FIG. 13, therein can be seen the manner in which the firing pin 80 and index knob 87 are able to be aligned with the holes 94 at the top of the firing chamber 64. The number and position of holes 94 correspond to the number and position of firing posts 68 of the multiple cartridge mount 65. The firing posts 68, holes 94, firing pin 80 and hammer are positioned so that they all lie in a straight line when the firing chamber housing 64 is positioned over the multiple-cartridge mount 65. Referring now simultaneously to FIGS. 12, 13, and 14, wedge-shaped sections 96 extend downward into the firing chamber 64 between the holes 94 at the top of the firing chamber 64 and the exhaust ports 66 to form individual C-shaped chambers for receiving percussion cap cartridges 7.

In the simple system 10 of FIG. 1, the point of impact for the rocket body 11 is the exposed percussion cap cartridge at the nose of rocket body 11. The entire impact force of the rocket hitting the ground or other surface is focused upon the firing post 12. The impact of the rocket striking a surface creates a maximized force between the impact surface and the firing post which detonates the percussion cap cartridge 7. The covered-nose systems 20, 40, 60 provide a means for detonating a percussion cap 7 while maintaining the safety inherent in a soft-nosed, light-weight toy projectile. Although the rocket bodies 11, 21, 41, 61 and nose coverings 27, 47, 67 may be made of any suitable safe light-weight, pliable, compressible material, polystyrene (commonly sold under the trademark Styrofoam) is particularly useful. For simplicity of construction, the projectile body and nose covering may be made of the same light-weight, pliable, compressible material. The manner in which the flip-top 20 and swivel-top 40 systems operate to detonate caps 7 is the same. The nose covering 27, 47 is compressible, and compresses when the projectile hits the ground or other surface. The impact of the projectile with a surface forces the strike plate 38, 58 toward the rocket body 21, 41, and in turn impels the firing pin 34, 54 toward the firing post 22, 42, detonating a cap cartridge 7 resting upon the post 22, 42. As discussed above, the impact force of the rocket is focused at the interface between the respective firing post 22, 42 and firing pin 34, 54. As the cap cartridge 7 is detonated, gases from the explosion are exhausted through the respective ports 26, 33 and 46.

The multiple-load system 60 may be cocked by grasping the hammer lever 82 to push the inclined top 84 of the hammer stem 83 through the opening 73 at the top of the hammer housing 71 until the notch 85 in the hammer stem 83 is engaged by the inner overhanging portion of the opening 73 at the top horizontal portion 74 of the assembly. The system 60 is fired when the trigger is forced against the inclined top edge 84 of the hammer stem 83. Pressure is applied against the trigger 90 by the impact force of the rocket hitting a surface and compressing the nose covering 67. The force of the trigger 90 against the inclined edge 84 pushes the hammer stem 83 and notch 85 away from the inner edge of hammer housing opening 73, thereby releasing the hammer. The spring 86 propels the firing pin 80 through an opening 94 in the firing chamber 64, forcing the firing pin 80 into rapid contact with a firing post 68 aligned under the hole 94. A percussion cap cartridge 7 is detonated by the impact force generated between the firing pin 80 and firing post 68. Once the cap has been detonated the assembly 70 may be grasped through the compressible nose cover 67 and rotated with respect to the firing chamber 64 until the firing pin 80 is aligned with a firing post 68 containing an un-detonated cap 7. Numerals 98 placed around the outside of the firing chamber 64 facilitate alignment. The spring-loaded 88 index knob 87 clicks into each hole 94 of the firing chamber 64 as the assembly 70 and firing chamber are rotated with respect to one another thereby facilitating alignment of the firing pin 80 over a hole 94. The wedge-shaped sections 96 of the firing chamber 64 form receptacles for receiving the cap cartridges 7 when the firing chamber 64 is screwed onto the top of the rocket body 61 to cover the cartridge mount 65. The holes 94 and exhaust ports 66 correspond to and are aligned with one another. The firing posts 68 of the multiple-cartridge mount 65 correspond to and are alignable with the center of the holes 94 and the exhaust ports 66 of the firing chamber 64. Thus, each mounted percussion cap cartridge 7 is mated with its own opening 94 for passage of the firing pin 80, individual C-shaped cartridge chamber formed by a pair of wedges 96, and exhaust port 66. The hammer guide 81, by centering the hammer and firing pin 80 with respect to the hammer housing 71 and hole 94 in the top of the firing chamber housing 64, also promotes alignment of the firing pin 80 with the firing posts 68. The rotational capability of the multiple cartridge mount 65 enables the nose to be screwed onto the top end of the rocket as the threads 62 of the top of the rocket are mated with the threads 92 on the inside of the firing chamber 64. Once the firing chamber 64 is screwed into place, the system is ready to be cocked and propelled for detonation.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. A toy projectile comprising:

a body having an outer covering of light-weight, pliable compressible material; and a firing post member for receiving a percussion cap cartridge affixed at an axial center of a front end of said body, adapted for detonating the percussion cap upon impact with a surface.

2. The toy projectile of claim 1, wherein said firing post member is affixed at an axial center of said front end of said body.

3. A toy projectile comprising:

a body having an outer covering of light-weight, pliable compressible material; and a firing post member for receiving a percussion cap cartridge affixed at a front end of said body adapted for detonating the percussion cap upon impact with a surface.

4. A toy projectile comprising:

a body of light-weight, pliable compressible material; and a firing post member for receiving a percussion cap cartridge directly affixed to said body at an axial center of a front end of said body adapted for detonating the percussion cap upon impact with a surface.

* * * * *